US010104926B2

(12) United States Patent
Witek et al.

(10) Patent No.: US 10,104,926 B2
(45) Date of Patent: Oct. 23, 2018

(54) APPAREL

(71) Applicant: Reebok International Limited, London (GB)

(72) Inventors: Danielle Witek, Quincy, MA (US); Emily Stableford, Boston, MA (US)

(73) Assignee: Reebok International Limited, London (GB)

( * ) Notice: Subject to any disclaimer, the term of this patent is extended or adjusted under 35 U.S.C. 154(b) by 202 days.

(21) Appl. No.: 15/185,402

(22) Filed: Jun. 17, 2016

(65) Prior Publication Data

US 2017/0360132 A1 Dec. 21, 2017

(51) Int. Cl.

| | |
|---|---|
| ***A41D 1/06*** | (2006.01) |
| ***A41F 9/02*** | (2006.01) |
| ***A41B 1/08*** | (2006.01) |
| ***A41D 3/00*** | (2006.01) |
| ***A41D 13/00*** | (2006.01) |
| ***A41D 1/22*** | (2018.01) |

(52) U.S. Cl.

CPC ..... *A41F 9/025* (2013.01); *A41B 1/08* (2013.01); *A41D 1/06* (2013.01); *A41D 1/22* (2013.01); *A41D 3/00* (2013.01); *A41D 13/0015* (2013.01)

(58) Field of Classification Search

CPC ..... A41D 1/06; A41D 27/08; A41D 13/02; A41F 1/00

See application file for complete search history.

(56) References Cited

U.S. PATENT DOCUMENTS

| | | | | | |
|---|---|---|---|---|---|
| 2,572,126 | A * | 10/1951 | Falone et al. | A41D 1/06 | 2/234 |
| 3,806,953 | A * | 4/1974 | Kalil | A41D 1/06 | 2/227 |
| 4,429,439 | A * | 2/1984 | Waugh | A44B 13/0017 | 2/219 |
| 4,580,298 | A * | 4/1986 | Tuisl | A41F 9/025 | 2/220 |
| 6,044,496 | A * | 4/2000 | Ramirez | A41F 9/025 | 2/219 |
| 6,138,277 | A * | 10/2000 | Gillen | A41D 13/015 | 2/102 |
| 2014/0317832 | A1* | 10/2014 | Allen | A41D 1/06 | 2/236 |
| 2016/0113341 | A1* | 4/2016 | Fildan | A44B 11/2596 | 450/91 |

* cited by examiner

*Primary Examiner* — Tejash Patel

(74) *Attorney, Agent, or Firm* — Sterne, Kessler, Goldstein & Fox P.L.L.C.

(57) ABSTRACT

A garment may include a waist portion having a fabric portion; a circumferential tightening device configured to tighten the waist portion, the circumferential tightening device including a first reversible tab and a second reversible tab spaced from each other along a circumferential direction, each tab attached to surface of the fabric portion at a proximal end of the reversible tab; each of the fabric portions having a fabric aperture formed therein and configured to allow the distal end of the corresponding tab to be inserted into the corresponding fabric apertures.

13 Claims, 4 Drawing Sheets

10
21
22
24
31
12
28
30

31
21
18
15
26
22
20

26
18
19
17
31
20

10
12
31
34
32
31
26
22
36
30
38
36
24

26
30
31
31
34
32
15
15
36
38
36

31
19
18
26
30
19
18
31
22
34
32
24
36
38
36

APPAREL

FIELD

Embodiments of the present invention generally relate to a garment. More particularly, embodiments of the present invention relate to garments that may be reversible, with reversible fasteners that offer the same or similar appearance regardless of which side of the garment is visible while being worn.

BACKGROUND

Various types of reversible garments with fasteners or circumferential tightening devices may be used.

BRIEF SUMMARY OF THE INVENTION

Reversible garments afford a benefit of additional appearances available for a user while only being a single garment structure. This allows for multiple appearances with the same fit, and additional certainty in how a particular garment will look on a user. Difficulties however arise when reversing garments while attempting to maintain the same outward appearance of the garments' fasteners. A need for an improved circumferential tightening device or fastener that can achieve the same or similar outward appearance regardless of which side of the reversible garment is facing out is identified.

Embodiments of the present invention relate to a garment including a waist portion having a fabric portion; a circumferential tightening device configured to tighten the waist portion, the circumferential tightening device comprising a first reversible tab and a second reversible tab spaced from each other along a circumferential direction, each tab attached to a first surface of the fabric portion at a proximal end of the reversible tab; each of the fabric portions having a fabric aperture formed therein and configured to allow the distal end of the corresponding tab to be inserted into the corresponding fabric aperture.

Additional embodiments relate to a garment as described, wherein each of the tabs include a tab aperture. In some embodiments, the circumferential tightening device further-comprises a tightening element configured to be inserted into a tab aperture on each of the tabs and configured to tighten the waist portion through engagement with the tabs. In embodiments, each of the fabric apertures includes an aperture reinforcement structure configured to reinforce the fabric aperture, attached to the first surface of at least one of the first and second fabric portions. In some embodiments, the fabric aperture reinforcement structure includes an aperture of the same dimension as the aperture formed in each of the first and second fabric portions. In embodiments, a fabric aperture reinforcing structure is disposed around each of the apertures. The fabric aperture reinforcement comprises one of additional fabric, stitching, polymer or rubber material, adhesive, or a structure attached with heat bonding in some embodiments. In some embodiments, the tab aperture is a grommet. In some embodiments, the garment is a lower body garment. In some embodiments, the garment is an upper body garment. In some embodiments, the garment further comprises a fly portion, the fly portion comprising a fly reinforcement such that when the garment is reversed the exterior facing surface of the fly lies flat. In some embodiments, the fly reinforcement comprises one of additional fabric, stitching, polymer or rubber material, adhesive, or a structure attached with heat bonding. In some embodiments, the first fabric portion and the second fabric portion are part of the same continuous fabric.

Embodiments of the present invention relate to a garment including a waist portion having a first fabric portion and a second fabric portion defining a space separating the fabric portions; a circumferential tightening device configured to tighten the waist portion, the circumferential tightening device comprising a first reversible tab and a second reversible tab spaced from each other along a circumferential direction, each tab attached to a first surface of at least one of the first or second fabric portions at a proximal end of the reversible tab in the space; each of the first and second fabric portions having at least two fabric apertures formed therein and configured to allow the distal end of the corresponding tab to be inserted into the corresponding fabric apertures.

Additional features of embodiments of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE DRAWINGS/FIGURES

The accompanying figures, which are incorporated herein, form part of the specification and illustrate embodiments of the present invention. Together with the description, the figures further serve to explain the principles of and to enable a person skilled in the relevant arts to make and use the invention.

DETAILED DESCRIPTION OF THE INVENTION

The present invention will now be described in detail with reference to embodiments thereof as illustrated in the accompanying drawings. References to "one embodiment", "an embodiment", "an example embodiment", "some embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The figures illustrate an embodiment of garment 10. In general, in some embodiments, a garment 10 includes a waist portion 12. The garment may comprise an upper body garment having a waist portion 12, such as for example, a jacket, or a lower body garment having a waist portion 12, such as, for example, a pair of shorts. It is contemplated that the garment 10 may include any suitable garment having a waist portion, including, but not limited to, shorts, board shorts, pants, shirts, jackets, dresses, athletic garments, dress garments, and other suitable apparel. Waist portion 12 generally includes the area of the garment that encircles the wearer's waist during use. In embodiments, the garment may be reversible, such that it can be turned "inside out" and worn with an opposing surface facing out.

Figures 1A, 1B, 1C:
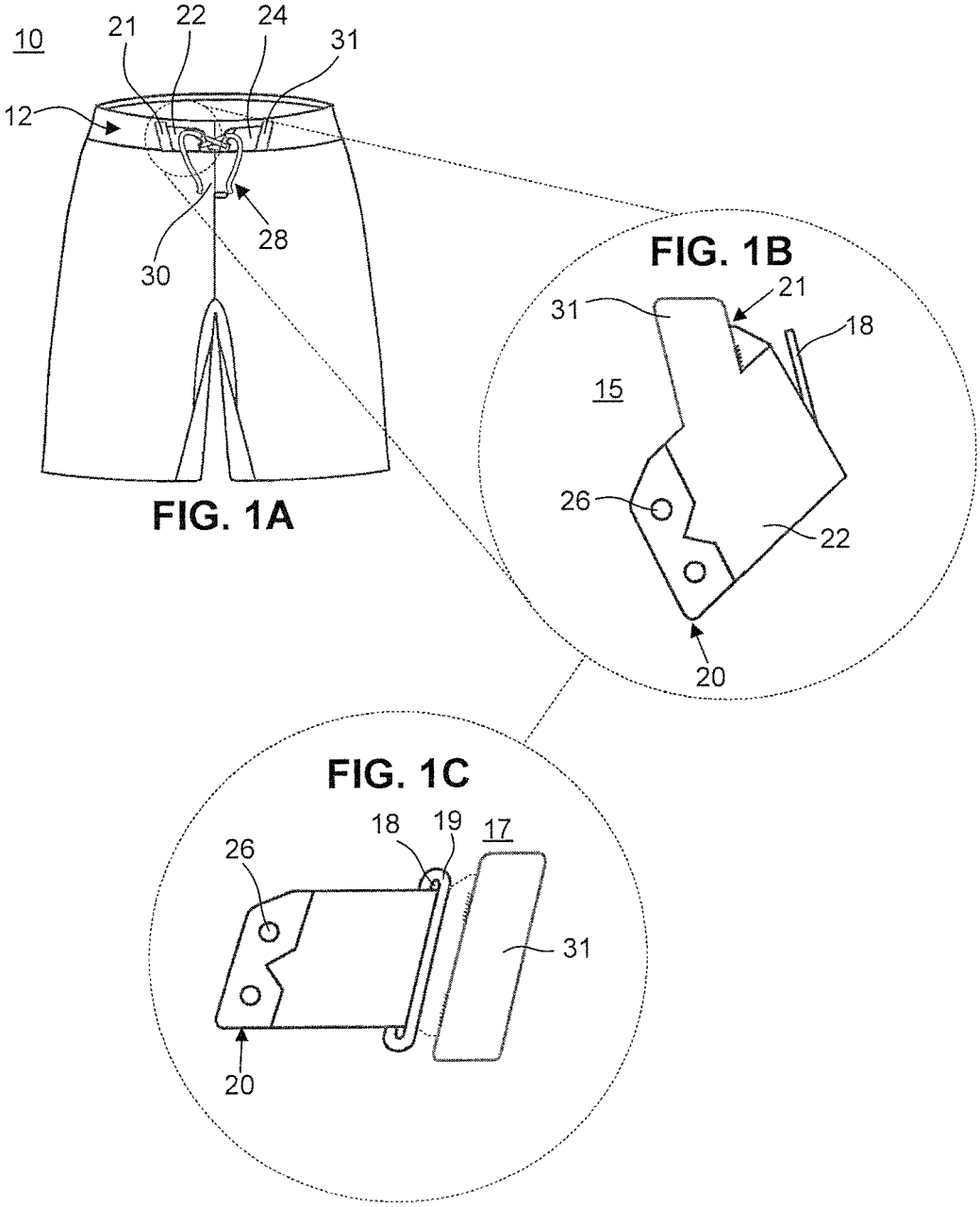
FIG. 1A is a perspective view of a garment according to an embodiment of the present invention.
FIG. 1B is an enlarged view of a portion of a garment according to an embodiment of the present invention shown in FIG. 1A.
FIG. 1C is an enlarged view of a portion of a garment according to an embodiment of the present invention shown in FIG. 1A.

In some embodiments, as shown in FIGS. 1A, 1B, and 2, the garment 10 may include a waist portion 12 having a first fabric portion 14 including a first surface 15. In embodiments, garment 10 may include a circumferential tightening device 20 configured to tighten the waist portion 12, and the circumferential tightening device 20 may include a first reversible tab 22 and a second reversible tab 24 spaced from each other along a circumferential direction. In some embodiments, each tab 22/24 may be attached to first surface 15 of fabric portions 14at a proximal end 21 of the reversible tab 22/24, through, for example, additional fabric, stitching, polymer or rubber material, adhesive, a structure attached with heat bonding, etc. In some embodiments, the proximal end 21 of the reversible tabs 22/24 may be attached, for example, with tab 31. In some embodiments, an additional masking tab 31 may be attached on the surface opposite the attachment, in order to cover, or mask, for example, apertures 18, thus hiding the reversibility of the tabs, as shown in FIGS. 1B and 1C, for example. Masking tab 31 may be for example, additional fabric, stitching, polymer or rubber material, adhesive, a structure attached with heat bonding, etc. In some embodiments, fabric portions 14may include a fabric aperture 18 formed therein and configured to allow the distal end 23 of the corresponding tab to be inserted into the corresponding fabric apertures 18. In this regard, when garment 10 is reversed (e.g. turned "inside out") the reversible tabs 22/24 may be pulled into or inserted through the corresponding aperture 18 to be exposed on the second surface 17 of the fabric portion. The exposed surface may be deemed an "exterior surface," but it is noted that because garment 10 is reversible, either side of the garment may be an "exterior surface," depending on the garment configuration.

FIG. 1A is a diagram of a garment 10 having waist portion 12. Garment 10 may include circumferential tightening device 20 configured to tighten the waist portion 10. Circumferential tightening device 20 may include a first reversible tab 22 and a second reversible tab 24 spaced from each other along a circumferential direction in some embodiments. In some embodiments, each tab 22/24 may be attached to first surface 15 of fabric portions 14 at a proximal end of the reversible tab 22/24.

FIG. 1B is a diagram of a close up view of a portion of the circumferential tightening device 20 shown in FIG. 1A. As shown, the distal end of the tab 22 may be inserted through aperture 18 and aperture reinforcement structure 19, while the proximal end of the tab 22 is attached to first surface 15 of the fabric portion. When the garment 10 is reversed, the distal end of the tabs may be inserted through the apertures 18.

As shown in the figures, if the garment 10 is reversed, the tab 22 may be pulled or pushed through the aperture 18 in fabric portion 14, thus maintaining the same appearance of the tab 22 once the garment 10 is reversed. In some embodiments, the circumferential tightening device 20 may include different fasteners, such as snaps, buttons, clips, buckles etc., which may also be reversed to allow for the similar finishing appearance when the garment 10 is reversed.

In embodiments, additional fabric portions may be the same continuous fabric material, or alternatively may be separate fabric material that are attached by suitable means, including, but not limited to, stitching, adhesive, and combinations thereof. In embodiments, the first or second surfaces 15/17 of fabric portions may include different prints such that the prints give a different appearance according to which side of the garment 10 is facing outward. In some embodiments, tabs 22/24 are made from the same prints, or different prints for a similar effect. In embodiments, tabs 22/24 are symmetrical. In some embodiments tabs 22/24 are asymmetrical. In embodiments, the fabric or material of the fabric portions and tabs may be such that the print or pattern of the opposite side or portion does not show through to the outside during use.

As shown in FIG. 1A, each of the tabs 22/24 may include a tab aperture 26 in some embodiments. The circumferential tightening device 20 may include a tightening element 28 configured to be inserted into a tab aperture 26 on each of the tabs 22/24 and configured to tighten the waist portion through engagement with the tabs (e.g., as in a board short design). The tightening element 28 may include a cord, rope, string, or other suitable tightening element. As shown in FIG. 1B, in some embodiments, each of the fabric apertures 18 includes an aperture reinforcement structure 19 configured to reinforce the fabric aperture 18. In some embodiments, the aperture reinforcement structure 19 may be attached to the first surface 15 of fabric portion 14, as shown in FIGS. 1A-1C. In some embodiments, the fabric aperture reinforcement structure 19 may include an aperture of the same dimension as the aperture 18 formed in fabric portion 14. In some embodiments, a fabric aperture reinforcing structure 19 may be disposed around each of the apertures 18. In embodiments, the fabric aperture reinforcement may include, for example, additional fabric, stitching, polymer or rubber material, adhesive, a structure attached with heat bonding, etc.

In some embodiments, the tab aperture 26 may include a grommet. In some embodiments, the garment 10 may be an upper body garment, or may be a lower body garment.

Figures 2A, 2B, 2C:
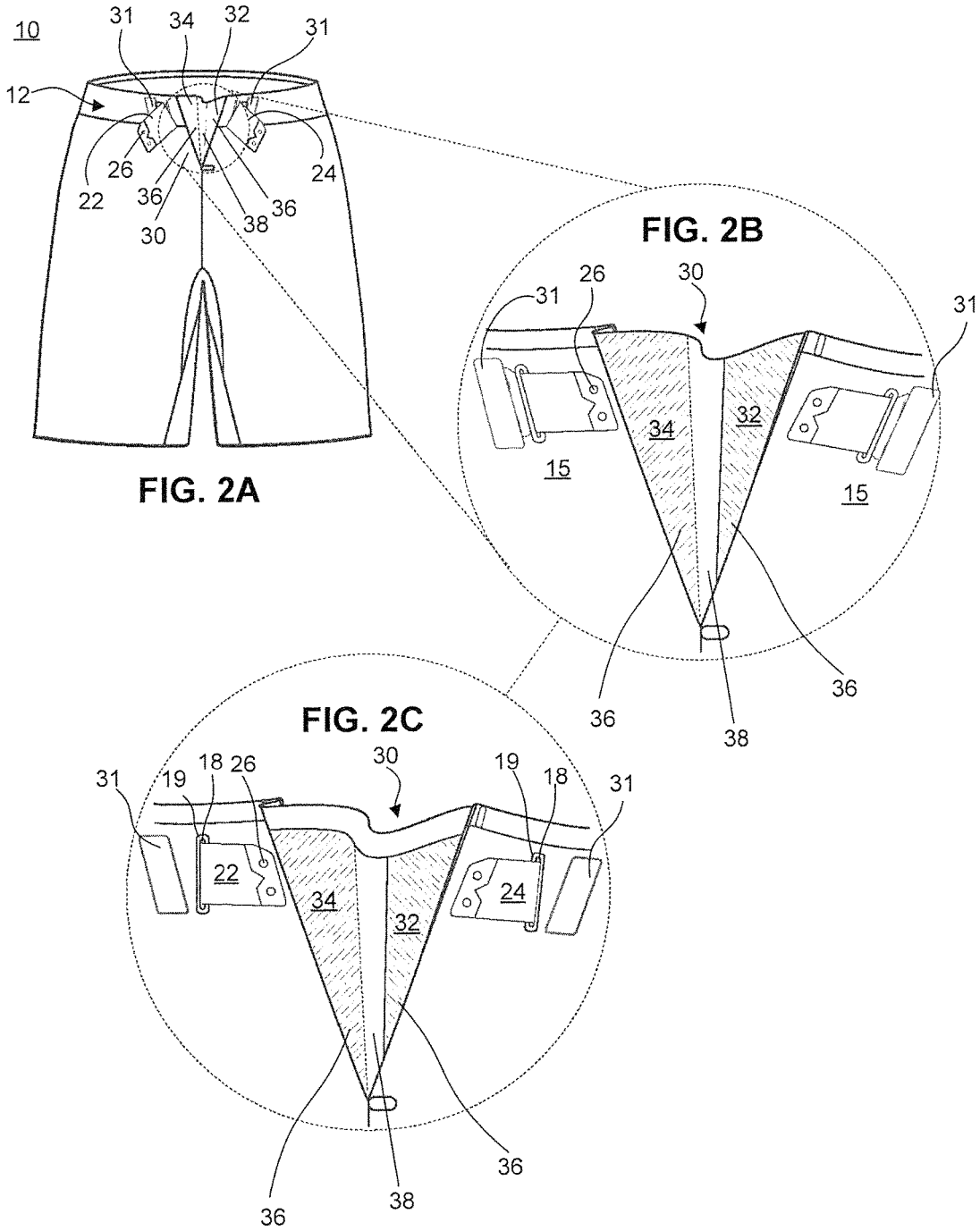
FIG. 2A is a perspective view of a garment according to an embodiment of the present invention.
FIG. 2B is an enlarged view of a portion of a garment according to an embodiment of the present invention shown in FIG. 2A.
FIG. 2C is an enlarged view of a portion of a garment according to an embodiment of the present invention shown in FIG. 2A.

As shown in FIGS. 2A-2C, the garment may include a fly portion 30. In some embodiments, fly portion 30 may include fly panel 34. In some embodiments, the fly portion 30 may include a fly reinforcement 32 such that when the garment is reversed the exterior facing surface of the fly portion 30 lies flat. In some embodiments, the fly reinforcement 32 may be additional fabric, stitching, polymer or rubber material, adhesive, a structure attached with heat bonding, etc, fastened to a portion of fly panel 34. In embodiments, the reinforcement zone 36 may be created through the addition of fly reinforcement 32. Non-reinforced zone 38 may be created through an absence of fly reinforcement 32. In some embodiments, additional fly reinforcement 32 may be applied to an opposite surface of fly panel 34 in order to create a foldable structure, having a non-reinforced zone 38 bounded by two reinforced zones 38, as shown in FIGS. 2B and 2C, respectively (showing a first configuration and second configuration of garment 10 being folded "inside out"). In embodiments, the weight or stiffness of the waist portion 12 may be configured such that the stability of the structure around the fly portion 30 is increased. In embodiments, the weight or stiffness of the fly portion 30 may be configured such that the stability of the structure around the fly portion 30 is increased. In embodiments, the weight or stiffness of the fly reinforcement 32 may be configured such that the stability of the structure around the fly portion 30 is increased. In some embodiments, the fly reinforcement 32 may be configured such that the fly may be tucked away easily when the garment 10 is reversed. In some embodiments, the fly reinforcement 32 may be configured between two fabric portions of the fly portion 30, similar to that of the aperture reinforcement structure 19. In some embodiments, the reinforced zones 36 and non-reinforced zone 38 are configured to increase foldability such that the fly portion 30 lies flat in either configuration of garment 10.

Figure 3A:
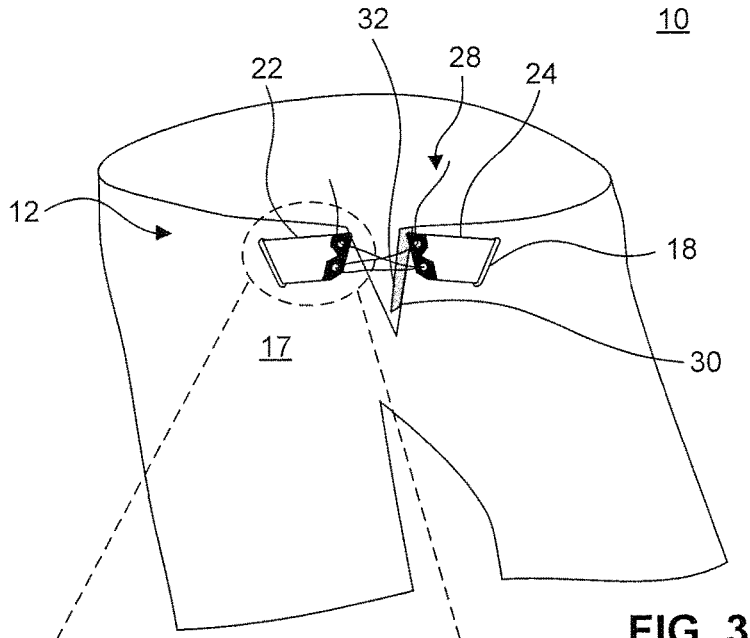
FIG. 3A is a perspective view of a garment according to an embodiment of the present invention.
Figure 3B:
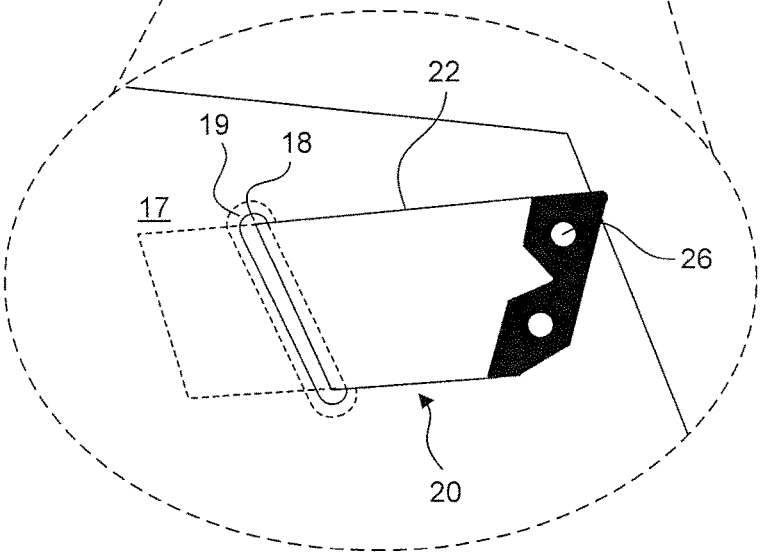
FIG. 3B is an enlarged view of a portion of a garment according to an embodiment of the present invention shown in FIG. 3A.
Figure 4:
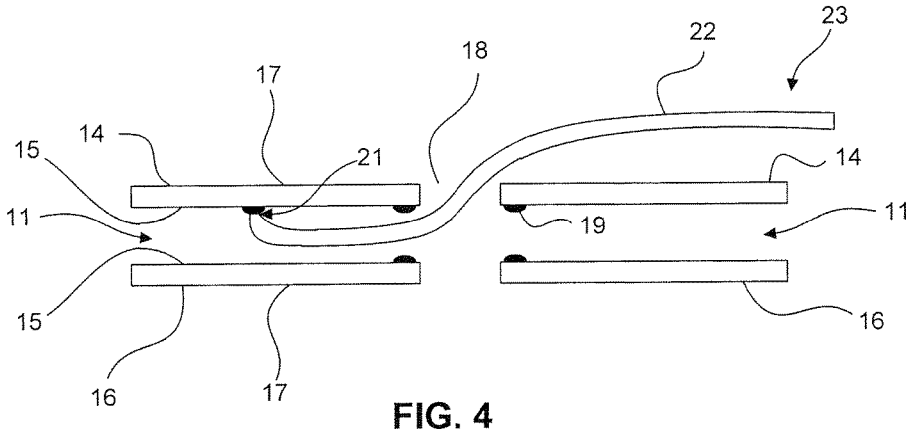
FIG. 4 is a simplified schematic view of a portion of a circumferential tightening device according to an embodiment of the present invention.

In some embodiments, as shown in FIGS. 3A, 3B, and 4, the garment 10 may include a waist portion 12 having a first fabric portion 14 and a second fabric portion 16 defining space 11 separating the fabric portions. In some embodiments, each tab 22/24 may be attached to a surface of at least one of the first or second fabric portions 14/16 within space 11 at a proximal end 21 of the reversible tab. In some embodiments, each of the first and second fabric portions 14/16 may include at least two fabric apertures 18 formed therein and configured to allow the distal end 23 of the corresponding tab to be inserted into the corresponding fabric apertures 18. In this regard, when garment 10 is reversed (e.g. turned "inside out") the reversible tabs 22/24 may be pulled into space 11 between the first and second fabric portions 14/16, and may be inserted through the opposing aperture 18 to be exposed on the second surface of the opposite first or second fabric portion. Waist portion 12 may have a first fabric portion 14 and a second fabric portion 16 forming a space separating the fabric portions. In some embodiments, each tab 22/24 may be attached to a surface of at least one of the first or second fabric portions 14/16 at a proximal end of the reversible tab 22/24. In some embodiments each of the first and second fabric portions 14/16 may have at least two fabric apertures 18 formed therein and configured to allow the distal end of the corresponding tab 22/24 to be inserted into the corresponding fabric apertures 18.

When the garment 10 is reversed, the distal end of the tab may be inserted through the apertures 18/19 and inserted through the opposing apertures on the opposing fabric portion.

FIG. 4 is a simplified cut-away view showing fabric portions 14/16, a proximal end of tab 22 attached at surface of fabric portion 14, and as it is inserted through aperture 18 and aperture reinforcement structure 19. As shown in the figure, if the garment 10 is reversed, the tab 22 may be pulled or pushed through the aperture 18 in fabric portion 14, and inserted through the aperture 18 in fabric portion 16, thus maintaining the same appearance of the tab 22 once the garment 10 is reversed. In some embodiments, the circumferential tightening device 20 may include different fasteners, such as snaps, buttons, clips, buckles etc., which may also be reversed to allow for the similar finishing appearance when the garment 10 is reversed.

In some embodiments, the aperture reinforcement structure 19 may be attached to the surface of at least one of the first and second fabric portions 14/16, as shown in FIG. 4.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A garment comprising:

a waist portion having a fabric portion;

a circumferential tightening device configured to tighten the waist portion, the circumferential tightening device comprising a first reversible tab and a second reversible tab spaced from each other along a circumferential direction, each of the first and second reversible tabs attached to a first surface of the fabric portion at a proximal end of the first and second reversible tabs; and a fly portion, the fly portion comprising a fly reinforcement such that when the garment is reversed an exterior facing surface of a fly lies flat, wherein the fabric portion includes an aperture formed therein and is configured to allow the distal end of a corresponding reversible tab to be inserted into a corresponding aperture.

2. The garment of claim 1, wherein each of the tabs includes a tab aperture.

3. The garment of claim 2, wherein the circumferential tightening device further comprises:

a tightening element configured to be inserted into the tab aperture on each of the first and second reversible tabs and configured to tighten the waist portion through engagement with the tabs.

4. The garment of claim 1, wherein each of the fabric apertures includes an aperture reinforcement structure configured to reinforce the fabric aperture, attached to the first surface the fabric portion.

5. The garment of claim 4, wherein the fabric aperture reinforcement structure includes an aperture of the same dimension as the aperture formed in the fabric portion.

6. The garment of claim 4, wherein a fabric aperture reinforcing structure is disposed around each of the apertures.

7. The garment of claim 4, wherein the fabric aperture reinforcement comprises one of additional fabric, stitching, polymer or rubber material, adhesive, or a structure attached with heat bonding.

8. The garment of claim 2, wherein the tab aperture is a grommet.

9. The garment of claim 1, wherein the garment is a lower body garment.

10. The garment of claim 1, wherein the garment is an upper body garment.

11. The garment of claim 1, wherein the fly reinforcement comprises one of additional fabric, stitching, polymer or rubber material, adhesive, or a structure attached with heat bonding.

12. A garment comprising:

a waist portion having a first and second fabric portion defining a space separating the fabric portions;

a circumferential tightening device configured to tighten the waist portion, the circumferential tightening device comprising a first reversible tab and a second reversible tab spaced from each other along a circumferential direction, each of the first and second reversible tabs attached to a first surface of the fabric portion at a proximal end of the first and second reversible tabs; and a fly portion, the fly portion comprising a fly reinforcement such that when the garment is reversed an exterior facing surface of a fly lies flat, wherein each of the fabric portions have an aperture formed therein and configured to allow the distal end of a corresponding reversible tab to be inserted into a corresponding aperture.

13. The garment of claim 12, wherein the first and second fabric portions are part of the same continuous fabric.

* * * * *